US005615663A

United States Patent [19]

Simonds

[11] Patent Number: 5,615,663

[45] Date of Patent: Apr. 1, 1997

[54] ARCHERY BOW WITH IMPROVED ADJUSTABLE GRIP

[75] Inventor: Gary L. Simonds, Gainesville, Fla.

[73] Assignee: Bear Archery, Inc., Gainesville, Fla.

[21] Appl. No.: 541,244

[22] Filed: Oct. 12, 1995

[51] Int. Cl.[6] ..... F41B 5/00

[52] U.S. Cl. ..... 124/88; 124/23.1

[58] Field of Search ..... 124/23.1, 86, 88

[56] References Cited

U.S. PATENT DOCUMENTS 3,407,799 10/1968 Reynolds ..... 124/88
3,415,241 12/1968 Bear ..... 124/88 X
4,966,124 10/1990 Burling ..... 124/23.1
5,081,979 1/1992 Burling ..... 124/23.1
5,241,945 9/1993 Shepley ..... 124/88
5,469,834 11/1995 Higgins et al. ..... 124/88

*Primary Examiner*—John a. Ricci
*Attorney, Agent, or Firm*—Milton Wolson

[57] ABSTRACT

An archery bow having an improved, laterally adjusted grip comprising a thumb side plate and a finger side plate moveable with respect to each other, and at least one adjustment insert located between the thumb side plate and the finger side plate.

8 Claims, 1 Drawing Sheet

ARCHERY BOW WITH IMPROVED ADJUSTABLE GRIP

BACKGROUND OF THE INVENTION

1. Field of the Invention

The present invention relates to archery bows and, in particular, to an improved, laterally adjustable grip for an archery bow.

2. Description of the Prior Art

U.S. Pat. No. 5,241,945, issued to Shepley, Jr., for an "Archery Bow with Laterally Adjustable Grip", discloses an adjustable grip for assisting the archer in achieving a consistent form to achieve accuracy with each shot. The adjustable grip includes a central channel which is wider than the riser. Spacers are provided between one or both sides of the grip and the riser to provide lateral adjustment of the grip. At somewhat greater expense, a continuous adjustment can be obtained by using a pair of tapered washers or by using an adjustment screw connected to the grip. In any case, the amount of adjustability of the grip is limited by the channel width of the grip.

It is an object of the present invention to provide an improved, laterally adjustable grip which, because it avoids use of a channel in the grip, permits a greater degree of adjustability of the grip.

SUMMARY OF THE INVENTION

The foregoing objective, and other objectives, are achieved by the present invention in which the grip comprises two unconnected side plates on opposite sides of the riser and one or more inserts located interior of the side plates for permitting adjustment of the grips.

A more complete understanding of the invention can be obtained by considering the following detailed description in conjunction with the accompanying drawing in which.

DETAILED DESCRIPTION OF THE INVENTION

Figure 1:
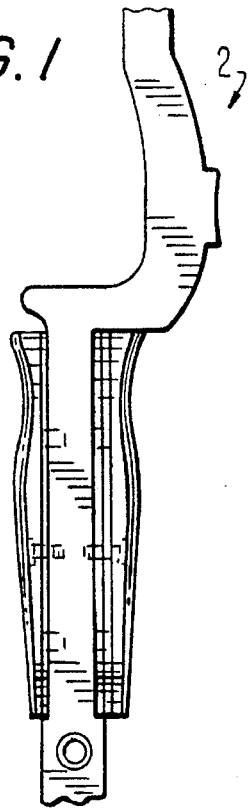
FIG. 1 is a front view, from the archer's direction, of an assembled grip constructed in accordance with the present invention.
Figure 2:
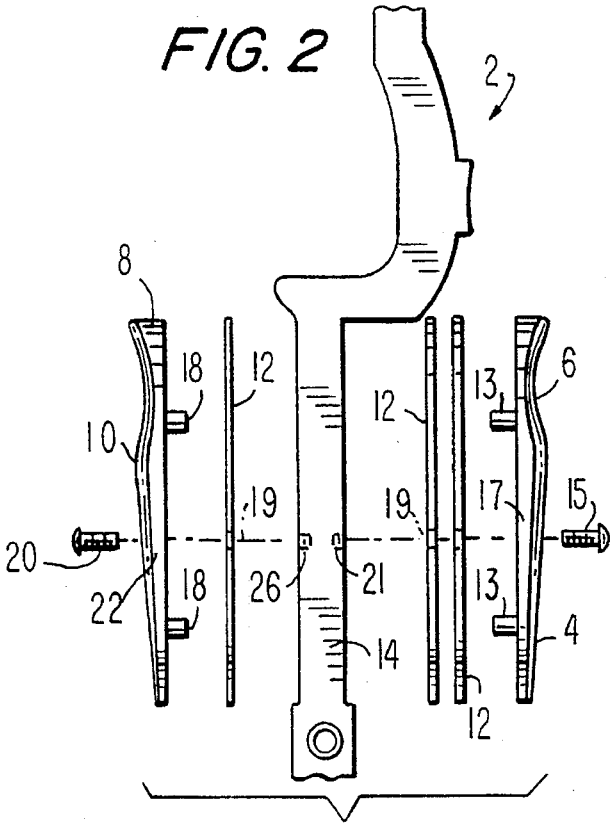
FIG. 2 is a front view, from the archer's direction, of a disassembled grip constructed in accordance with the present invention.
Figure 3:
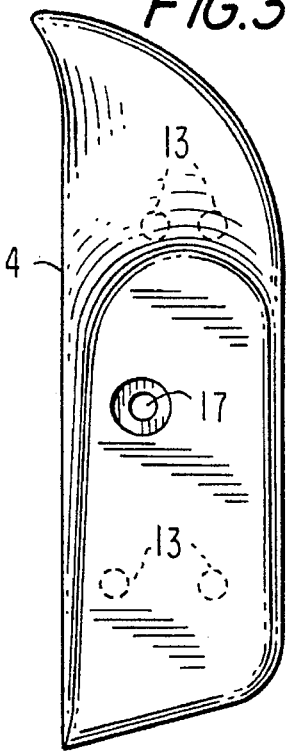
FIG. 3 is a side view of the outer surface of the thumb side plate of the grip of the present invention.
Figure 4:
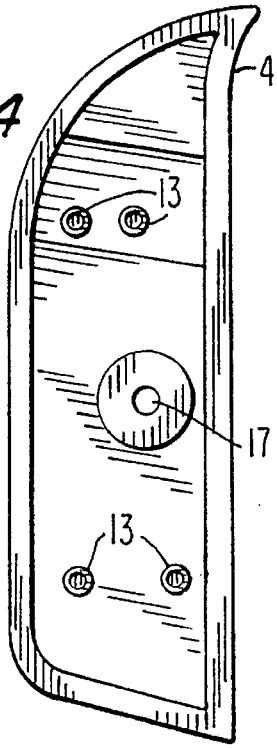
FIG. 4 is a side view of the inner surface of the thumb side plate of the grip of the present invention.
Figure 5:
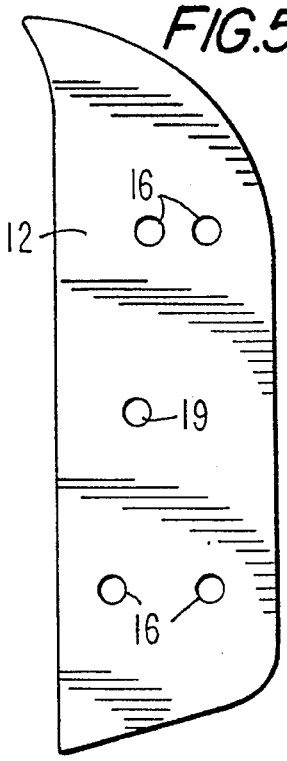
FIG. 5 is a side view of an adjustment insert of the grip of the present invention.

The grip 2 of the present invention comprises thumb side plate 4 having an indented thumb portion 6 and a finger side plate 8 having a concave portion 10. One or more adjustment inserts 12 are positioned between the thumb side plate 4 and a riser handle portion 14 and/or finger side plate 8 and riser handle portion 14. The number of adjustment inserts 12 and the determination of which side of the riser handle portion 14 the adjustment inserts 12 will be positioned, is dependent on the particular grip of the archer. Obviously, more adjustment inserts 12 are utilized by archers having larger hands, and less adjustment inserts 12 are utilized for archers having smaller hands.

Thumb side plate 4 includes projections 13 which extend into openings 16 in one or more of the adjustment inserts 12 for maintaining the adjustment inserts 12 in fixed relationship with thumb side plate 4 and both items in fixed relationship with the riser handle 14. To assemble the thumb side plate 4 and adjustment inserts 12 to riser handle portion 14, a screw 15 is inserted through opening 17 in thumb side plate 4, and opening 19 in adjustment insert 12, and then screwed into threads 21 of riser handle portion 14. In a similar manner, finger side plate 8 includes projections 18 (identical to projections 13 of thumb side plate 4) which extend into the openings 16 in one or more adjustment inserts 12 on the other side of riser handle portion 14 for maintaining the adjustable inserts 12 in fixed relationship with finger side plate 8. A screw 20 is inserted through opening 22 in finger side plate 8 (identical to opening 17 in thumb side plate 4) and through opening 19 in adjustment inserts 12 and then screwed into threads 26 of riser handle portion 14. The length of screws 15 and 20 would be increased to accommodate an increased number of adjustable inserts 12. It will be noted that the width of the grip may be varied to accommodate the size of the archer's hand by adding or decreasing the number of adjustable inserts 12 on one or both sides of riser handle portion 14.

Having thus described the invention, it will be apparent to those skilled in the art that various modifications can be made within the scope of the invention.

I claim:

1. An archery bow having a riser handle portion and an improved laterally adjustable grip affixed to said riser handle portion, said grip comprising a thumb side plate and a finger side plate, said thumb side plate and finger side plate moveable with respect to each other, and at least one adjustment insert located between the thumb side plate and the finger side plate.

2. An archery bow as set forth in claim 1, wherein said thumb side plate, said finger side plate, and said at least one adjustment insert have openings therein, said riser handle portion having threaded portions therein, and screws insertable through said openings and threaded into the riser handle portion for securing the thumb side plate, the finger side plate, and at least one adjustment insert to the riser handle portion.

3. An archery bow as set forth in claim 1, wherein said thumb side plate and said finger side plate have projections thereon which extend into other openings in said at least one adjustment insert for maintaining the thumb side plate and finger side plate in fixed relation to said at least one adjustment insert.

4. An archery bow as set forth in claim 1, wherein said at least one adjustment insert is located between the thumb side plate and the riser handle portion.

5. An archery bow as set forth in claim 1, wherein said at least one adjustment insert is located between the finger side plate and the riser handle portion.

6. An archery bow as set forth in claim 1, wherein said at least one adjustment insert is located between the thumb side plate and the riser handle portion and between the finger side plate and the riser handle portion.

7. An archery bow as set forth in claim 1, wherein the thumb side plate has an indented portion thereon.

8. An archery bow as set forth in claim 1, wherein the finger side plate has a concave portion thereon.

* * * * *